US006540598B1

(12) United States Patent
McCutchen

(10) Patent No.: US 6,540,598 B1
(45) Date of Patent: Apr. 1, 2003

(54) ABOVE FLOOR VACUUM SHROUD FOR A FLOOR GRINDING MACHINE

(75) Inventor: Travis D. McCutchen, Owasso, OK (US)

(73) Assignee: 4M Enterprises, Hominy, OK (US)

( * ) Notice: Subject to any disclaimer, the term of this patent is extended or adjusted under 35 U.S.C. 154(b) by 0 days.

(21) Appl. No.: 10/027,636

(22) Filed: Dec. 21, 2001

(51) Int. Cl.[7] ..... B24B 55/06

(52) U.S. Cl. ..... 451/456; 451/350; 451/352; 451/353; 451/359

(58) Field of Search ..... 451/350, 352, 451/353, 359, 456

(56) References Cited

U.S. PATENT DOCUMENTS 5,609,516 A * 3/1997 Courson et al. ..... 451/456
5,791,979 A 8/1998 Duncan
6,027,399 A * 2/2000 Stewart ..... 451/353
6,328,643 B1 * 12/2001 Huber ..... 451/357

* cited by examiner

*Primary Examiner*—Joseph J. Hail, III
*Assistant Examiner*—Shantese McDonald
(74) *Attorney, Agent, or Firm*—Frank J. Catalano

(57) ABSTRACT

A vacuum shroud for a floor grinding machine has a rigid cover with a cylindrical skirt and a vacuum port. The skirt is concentrically disposed above the grinding wheel. A flexible cylindrical guard has a plurality of vertical ribs protruding inwardly from its upper portion against the lower outer periphery of the skirt and extends downwardly to a plane slightly above the plane of the grinding surface of the grinding wheel. The ribs and skirt define a plurality of vertical air inlet passages which communicate from outside the cover to the vacuum port. The guard bottom rim and the floor define an annular air inlet passage around the periphery of the grinding wheel which communicates from outside the guard to the vacuum port. The air flow caused by the vertical and annular air flow passages prevents dust and debris from escaping the shroud.

7 Claims, 5 Drawing Sheets

ABOVE FLOOR VACUUM SHROUD FOR A FLOOR GRINDING MACHINE

BACKGROUND OF THE INVENTION

This invention relates generally to floor grinding machines and more particularly concerns vacuum shrouds for containing dust, debris and particulates generated by the grinding process.

Older known floor grinding machines fill the air with dust and debris in a matter of minutes, making extended use inefficient, uncomfortable and unhealthy. More modern floor grinding machines use vacuum systems in an effort to reduce the dispersion of pollutants. They are ineffective because the centrifugal force at the open perimeter of the grinding wheel overcomes the vacuum suction sufficiently to quickly fill the air with dust and debris. To overcome this problem flexible shrouds have been designed so as to maintain floor contact and contain the dust and debris. However, if the machine is not flatly oriented to the floor during use, these flexible shrouds are ineffective. High volumes of dust and debris are still dispersed during the intervals in which the machine is tilted enough to expose a gap to the outer environment. These flexible shrouds are also quickly destroyed should they flex into the path of the grinding wheel. This happens most frequently when the grinding machine is used in close proximity to a wall. When the shroud is deflected into the wheel, not only is the shroud destroyed but the wheel also cuts into and damages the wall. To avoid this problem, some machines use shrouds with a diameter much greater than the diameter of their grinding wheels, but then the grinding machine cannot be positioned close to a wall or other obstacles. Also, the large diameter shroud blocks the operator's view of the grinding wheel and the work area.

A most recent machine uses a shroud designed to maintain full contact with the floor so as to maintain vacuum suction regardless of any tilting of the grinding wheel. However, since suction is achieved by a complete seal of the shroud against the floor, the machine is pulled against the floor. This makes the machine difficult to maneuver. If the machine is tilted while suction is maintained, the angle of the grinding wheel and the force of suction cause the machine to skip out of control. If the seal is broken at all, perhaps as a result of the runaway motion of the machine or the force applied by the operator to maintain control or because of a high spot or irregularity on the floor surface, the air is filled with dust and debris as quickly as with older machines. In addition, since the shroud extends to the floor, the operator cannot see the grinding wheel or the work area. It is, therefore, difficult to properly position the machine on the floor, especially in tight areas such as next to walls and in corners without damaging the shroud and then the wall. Furthermore, the complex structure of this shroud makes it very expensive and difficult to replace.

It is, therefore, an object of this invention to provide a floor grinding machine vacuum shroud which does not contact the floor. Another object of this invention is to provide a floor grinding machine vacuum shroud which does not require a seal with the floor. A further object of this invention is to provide a floor grinding machine vacuum shroud which does not have a diameter significantly greater than the diameter of the grinding wheel. Yet another object of this invention is to provide a floor grinding machine vacuum shroud which does not cause the machine to suck against the floor. It is also an object of this invention to provide a floor grinding machine vacuum shroud which does not flex into the path of the grinding wheel. Still another object of this invention is to provide a floor grinding machine vacuum shroud which does not cause a tilted machine to run away. An additional object of this invention is to provide a floor grinding machine vacuum shroud which creates a flow of air around the periphery of the grinding wheel to control the dust and debris within the shroud. Another object of this invention is to provide a floor grinding machine vacuum shroud which permits the machine to be operated very close to walls and other obstacles. A further object of this invention is to provide a floor grinding machine vacuum shroud which is easily replaced in comparison to known shrouds. Yet another object of this invention is to provide a floor grinding machine vacuum shroud which is inexpensive in comparison to known shrouds.

SUMMARY OF THE INVENTION

In accordance with the invention, a vacuum shroud is provided for covering a grinding wheel mounted on the drive shaft of a floor grinding machine. A rigid cover has a central opening in its top through which the machine drive shaft is extended to the grinding wheel. A cylindrical skirt on the cover has a diameter preferably equal to but not less than the diameter of the grinding wheel. The skirt is concentrically disposed above the grinding wheel. A vacuum port extends through the cover. A flexible and resilient cylindrical guard has a plurality of vertical ribs inwardly protruding from its upper portion. The ribs abut the lower outer periphery of the skirt and the lower portion of the guard extends downwardly to its bottom rim which lies in a plane slightly above the plane of the grinding surface of the grinding wheel. The ribs and skirt define a plurality of vertical air inlet passages which communicate from outside of the cover to the vacuum port. The guard bottom rim is cooperable with the floor to define an annular air inlet passage around the periphery of the grinding wheel which communicate from outside of the guard to the vacuum port. A mechanism is provided for securing the ribs in abutment with the skirt, preferably a strap with an adjustable buckle for reducing the length of the strap to clamp the ribs against the skirt. Most preferably, the strap is disposed within the upper portion of the guard, perhaps by molding the strap into the upper portion of the guard. The ribs must extend at least to the bottom of the lower outer periphery of the skirt and, for best results, the ribs should extend slightly below the lower outer periphery of the skirt. Preferably, the cover is made of steel and the guard is made of polyurethane.

BRIEF DESCRIPTION OF THE DRAWINGS

Other objects and advantages of the invention will become apparent upon reading the following detailed description and upon reference to the drawings in which.

Figure 1:
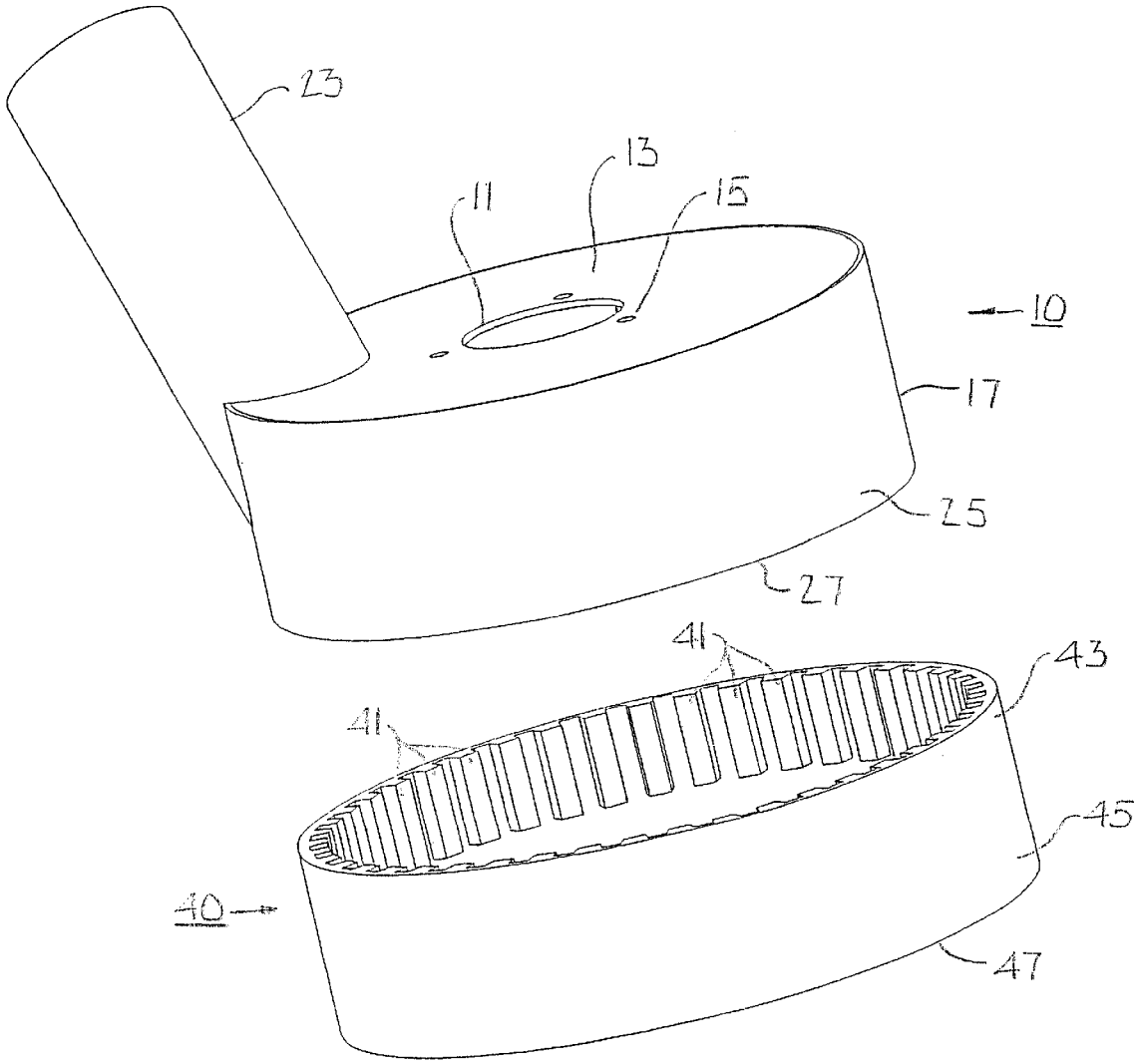
FIG. 1 is a perspective assembly view of a preferred embodiment of the above floor grinding machine vacuum shroud.
Figure 2:
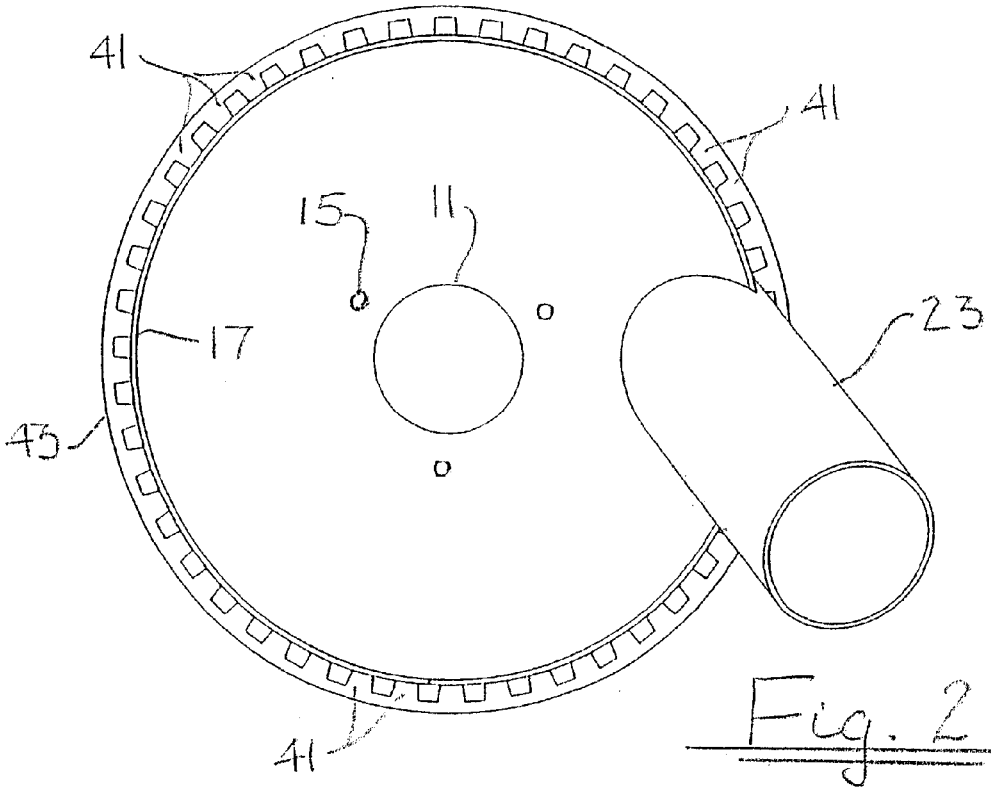
FIG. 2 is a top plan view of the shroud of FIG. 1.
Figure 3:
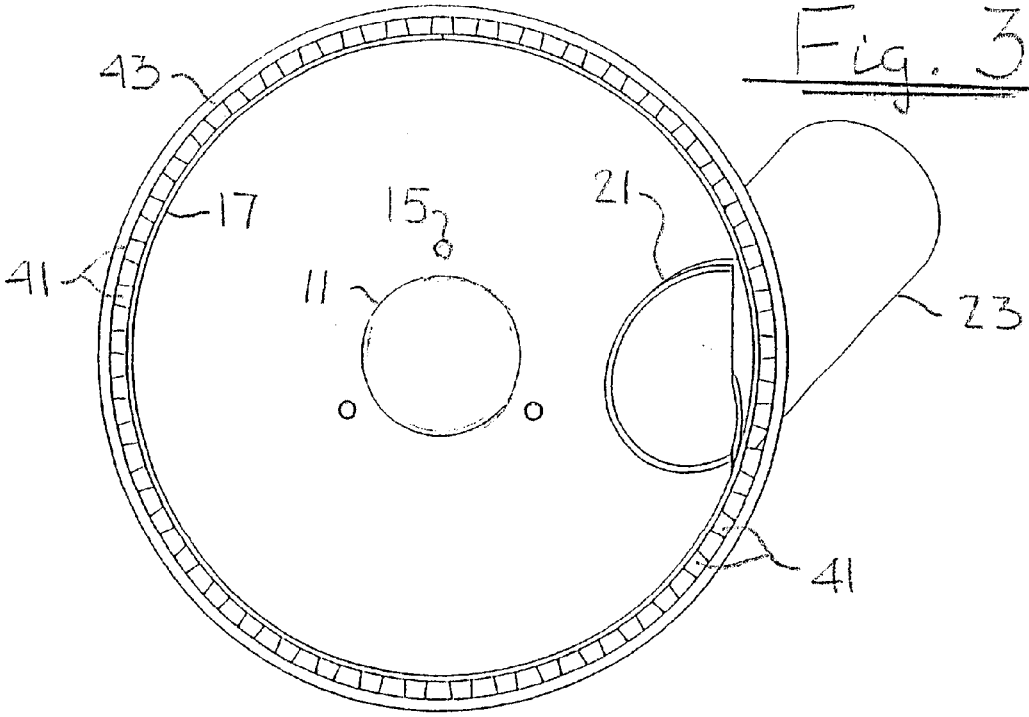
FIG. 3 is a bottom plan view of the shroud of FIG. 1.
Figure 4:
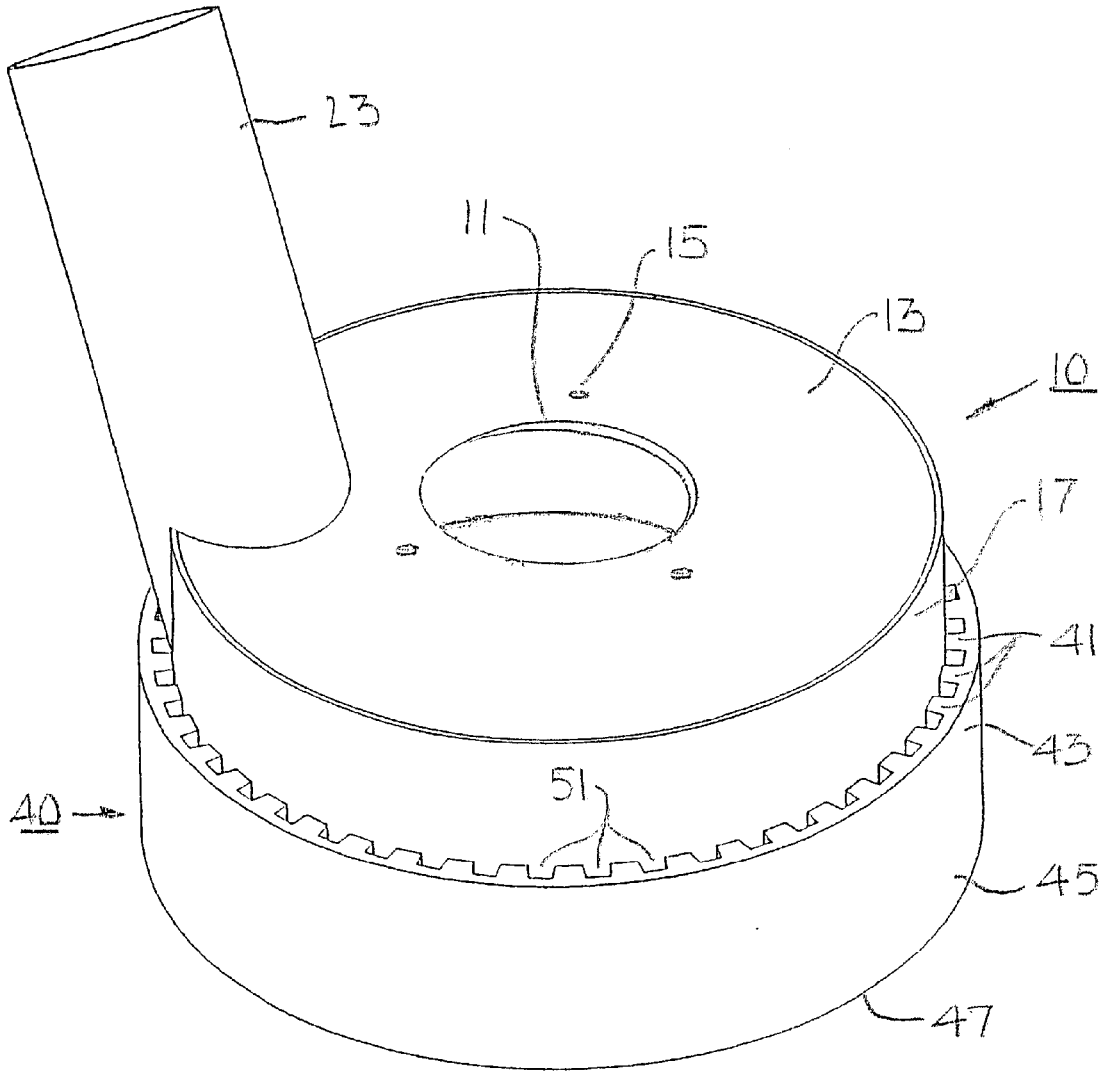
FIG. 4 is a perspective view of the shroud of FIG. 1 in its assembled condition.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Looking at FIGS. 1–4 generally, a preferred embodiment of the vacuum shroud for covering a grinding wheel mounted on the drive shaft of a floor grinding machine is illustrated. The shroud consists of a cover 10 and a guard 40.

The cover 10 is a rigid structure, preferably of steel, with a central opening 11 in its top 13. The drive shaft (not shown) of the machine will be inserted downwardly through the central opening 11 into the cover 10. Mounting holes 15 provided around the central opening 11 facilitate fastening the cover 10 to the machine. As shown, the top 13 is circular and a cylindrical skirt 17 extends downwardly from the perimeter of the top 13. A vacuum port 21 through the cover 10 opens into a tube 23 for connection to the machine vacuum system.

The guard 40 is a flexible resilient cylinder, preferably molded from polyurethane. The guard 40 has a plurality of vertical ribs 41 protruding inwardly from an inner upper portion 43 of the guard 40. The ribs 41 are spaced apart by distances approximately equal to the width of the ribs 41.

Figure 5:
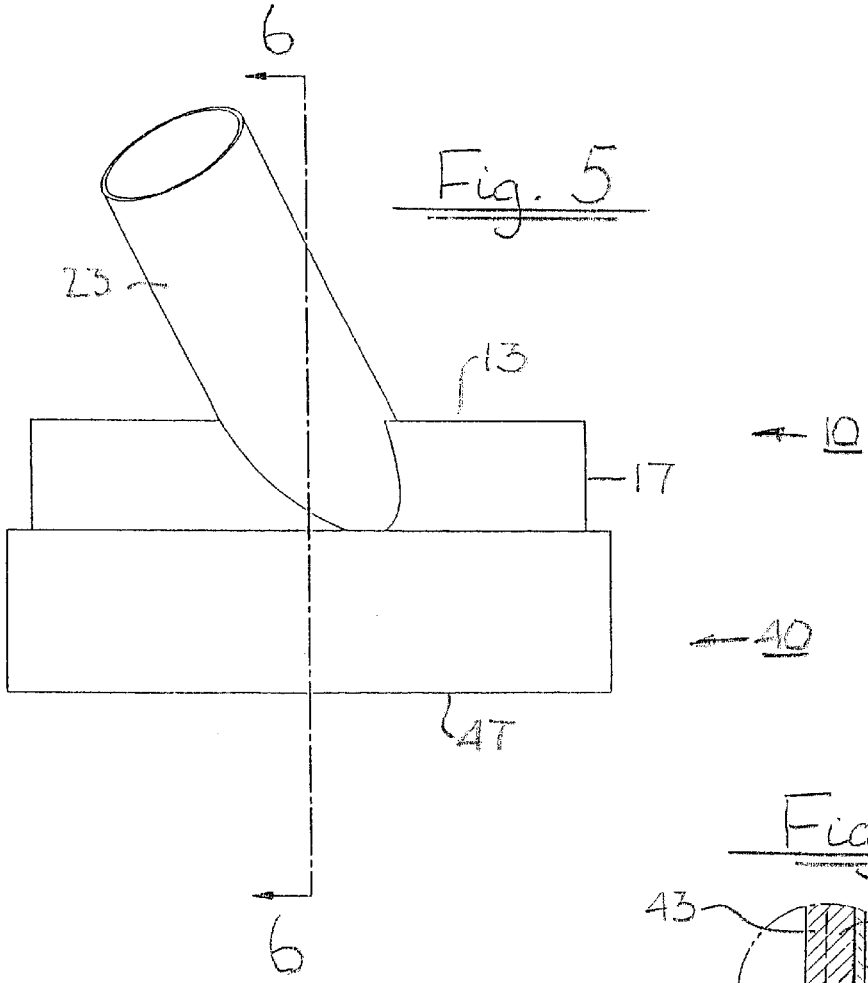
FIG. 5 is a side elevation view of the shroud of FIG. 1.
Figure 7:
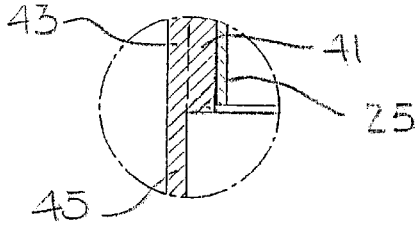
FIG. 7 is an exploded view of the area 6—6 of FIG. 5.
Figure 6:
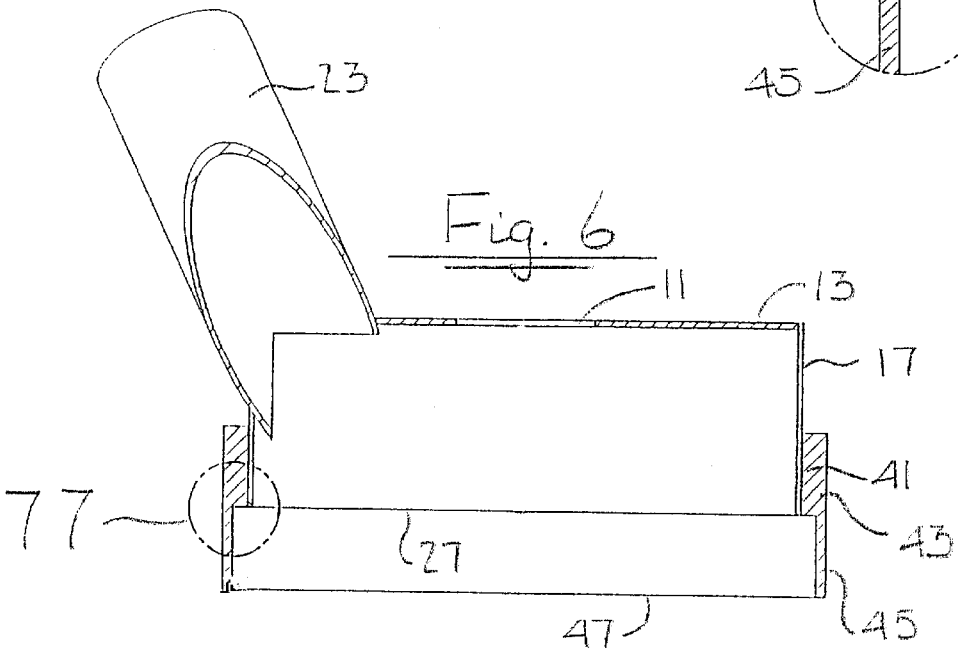
FIG. 6 is a cross-sectional view taken along the line 5—5 of FIG. 4.
Figure 8:
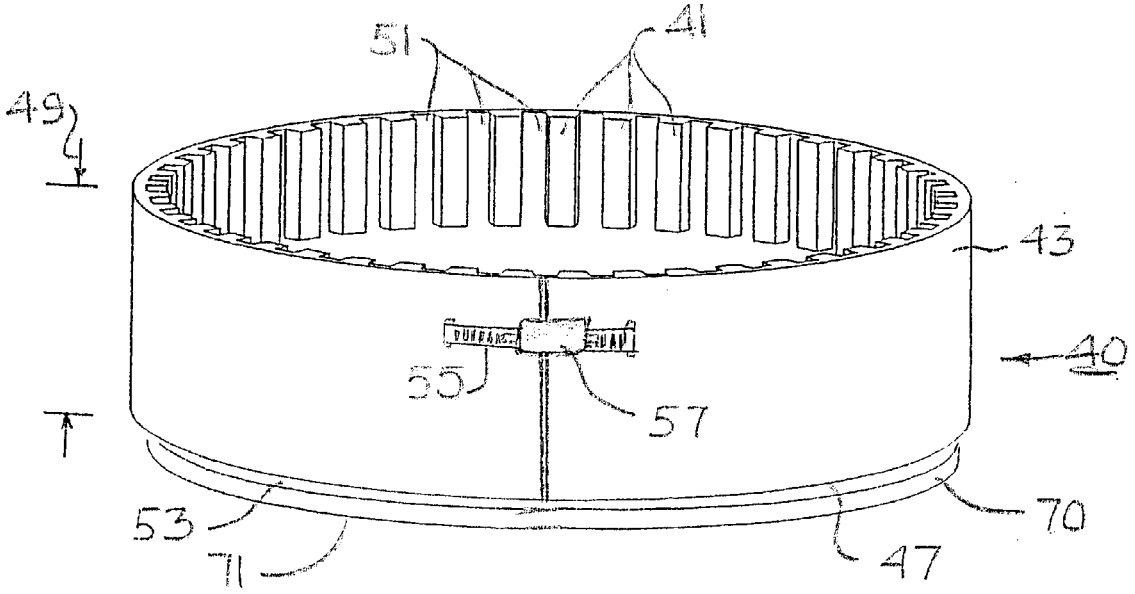
FIG. 8 is a perspective view illustrating the relationship of the guard of the shroud of FIG. 1 to the machine grinding wheel.

As best seen in FIGS. 5–7, the inside surfaces of the ribs 41 abut a lower outer periphery 25 of the skirt 17. The lower edges of the ribs 41 extend at least to the same plane as the bottom rim 27 of the cover 10. Preferably, as best seen in FIG. 7, the ribs 41 extend at least slightly below the bottom rim 27 of the cover 10 by a distance in the order of ⅛" to ¼". At ¼" and greater, the efficiency of the shroud diminishes. As is best seen in FIG. 8, the inside diameter of the guard 40 is equal to or slightly greater than the diameter of the grinding wheel 70 and the bottom rim 47 of the guard 40 is concentrically disposed above the grinding wheel 70. The depth 49 of the guard 40 is such that the lower portion 45 of the guard 40 extends downwardly to its bottom rim 47 so that the plane of the bottom rim 47 is above the plane of the grinding surface 71 of the grinding wheel 70. Thus, the guard 40 does not come in contact with the floor during the floor grinding process. Preferably, the distance between the planes of the bottom rim 47 of the guard 40 and the grinding surface 71 of the grinding wheel 70 is in the order of 0.015–0.030". By way of example, in a prototype for a machine with a seven inch grinding wheel, a cover 10 of seven inches diameter, is used with a guard 40 which has a 7 ¾" outer diameter, a 7 ⅜" inner diameter to the lower portion 45 of the guard 40 and a 7" inner diameter to the surface of the ribs 41.

The ribs 41 and the skirt 17 define a plurality of vertical air inlet passages 51 which communicate from outside the cover 10 to the vacuum port 21. That is, in operation, the vacuum suction will draw air downwardly from outside of the cover 10 through the passages 51 below the bottom rim 27 of the cover and then upwardly into the tube 23 through the vacuum port 21. As shown, the tube 23 is angularly aligned with respect to the perimeter of the cover 10 to create an air vortex in the cover 10. Furthermore, the bottom rim 27 of the skirt 17 cooperates with the floor (not shown) to define the annular air inlet passage 53 at the periphery of the grinding wheel 70. This annular air passage 53 communicates from outside of the guard 40 through the vacuum port 21 to the vacuum tube 23, the area of the annular passage 53 being sufficiently minimized so as to create an air flow barrier strong enough to overcome the centrifugal force applied to the dust and particles without providing a perfect seal which would cause the machine to be sucked against the floor. If the distance between the bottom planes of the guard 40 and the wheel 70 significantly exceeds 0.030", the shroud still functions, but larger pieces of debris may be discharged through the annular air passage 53.

As seen in FIG. 8, a strap 55, preferably of steel, is annularly disposed within the upper portion 43 of the guard 40. Preferably, the strap 55 is molded into the upper portion 43 of the guard 40. The ends of the strap 55 extend through the outer walls of the guard 40 and are engaged in a threaded screw clamp 57 so that the length of the strap 55 can be reduced to clamp the ribs 41 against the skirt 17. This configuration facilitates rapid replacement of the guard 40 by adjusting the screw clamp 57 to loosen the strap 55 so that the old guard 40 can be slipped off the cover 10 and a new guard 40 slipped on and secured by use of its screw clamp 57.

Thus, it is apparent that there has been provided, in accordance with the invention, an above floor vacuum shroud for a floor grinding machine that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A vacuum shroud for covering a grinding wheel mounted on a drive shaft of a floor grinding machine, the shroud comprising:

a rigid cover having a central opening in a top thereof for receiving the machine drive shaft therethrough, a cylindrical skirt having a diameter not less than a diameter of the grinding wheel for concentric disposition above the grinding wheel and a vacuum port therethrough; and a flexible and resilient cylindrical guard having a plurality of vertical ribs inwardly protruding from an upper portion thereof, said ribs abutting a lower outer periphery of said skirt with a lower portion of said guard extending downwardly to a bottom rim thereof in a a plane above a plane of a grinding surface of the grinding wheel, said ribs and said skirt defining a plurality of vertical air inlet passages communicating from outside of said cover to said vacuum port and said guard bottom rim being cooperable with the floor to define an annular air inlet passage around a periphery of the grinding wheel communicating from outside of said guard to said vacuum port.

2. A vacuum shroud according to claim 1 further comprising means for securing said ribs in abutment with said skirt.

3. A vacuum shroud according to claim 2, said securing means comprising a strap and means for reducing a length of said strap to clamp said ribs against said skirt.

4. A vacuum shroud according to claim 3, said strap being disposed within said upper portion of said guard.

5. A vacuum shroud according to claim 4, said strap being molded into said upper portion of said guard.

6. A vacuum shroud according to claim 1, said ribs extending slightly below said lower outer periphery of said skirt.

7. A vacuum shroud according to claim 1, said cover being made of steel and said guard being made of polyurethane.

* * * * *